US006761207B1

(12) United States Patent
Homer

(10) Patent No.: US 6,761,207 B1
(45) Date of Patent: Jul. 13, 2004

(54) SCREENED DOOR COVERING

(76) Inventor: Cassi Clarke Homer, 7309 Sideoats Dr., Crestwood, KY (US) 40014

( * ) Notice: Subject to any disclaimer, the term of this patent is extended or adjusted under 35 U.S.C. 154(b) by 0 days.

(21) Appl. No.: 10/346,842

(22) Filed: Jan. 17, 2003

Related U.S. Application Data

(60) Provisional application No. 60/349,680, filed on Jan. 17, 2002.

(51) Int. Cl.[7] ..... E06B 3/00

(52) U.S. Cl. ..... 160/368.1; 160/349.1

(58) Field of Search ..... 160/368.1, 354, 160/327, 330, 126, 348, 349.1, 349.2, 84.01

(56) References Cited

U.S. PATENT DOCUMENTS 4,053,007 A 10/1977 Griffith
5,323,835 A 6/1994 Bachmeier
5,392,835 A 2/1995 Widlt
5,427,169 A 6/1995 Saulters
5,701,813 A 12/1997 Smith
5,720,080 A 2/1998 Rose
5,911,266 A * 6/1999 Jacobs ..... 160/368.1
6,131,639 A 10/2000 McMillen et al.
6,209,614 B1 4/2001 Smoot
6,257,307 B1 7/2001 Tollivar

* cited by examiner

*Primary Examiner*—David Purol
(74) *Attorney, Agent, or Firm*—Middleton Reutlinger

(57) ABSTRACT

A screened door covering made from mesh screening material hanging loosely in a doorway to create a mesh barrier against dirt and insects across the doorway, while permitting easy passage by humans and animals across the barrier. The mesh screening material has a width greater than the width of the doorway. The excess material is gathered in folds on the sides of the doorway. This configuration provides a good mesh barrier across a doorway without requiring that the sides or bottom of the mesh material be mounted in a rigid frame.

21 Claims, 3 Drawing Sheets

SCREENED DOOR COVERING

CROSS-REFERENCE TO PRIOR APPLICATIONS

This application claims priority to U.S. Provisional Patent Application Serial No. 60/349,680, filed on Jan. 17, 2002, which is incorporated herein by reference.

BACKGROUND

The present invention is related to a screen for mounting across a door opening. The screen hangs loosely in the door frame so that small children or pets can pass through the screen easily, but insect and debris entry is restricted.

The typical screen covering for a door comprises a mesh screening material mounted in a wood or metal frame similar in design and proportion to a standard door. However, this design requires the user to open the screened door in order to pass through the doorway. Some alternative designs, such as the screen assemblies described in U.S. Pat. No. 6,131,639 and U.S. Pat. No. 5,427,169, have eliminated the frame thereby allowing the screening material to hang freely in the doorway. But these designs can allow small gaps or open spaces remain along the sides of the screening material allowing the insects and debris to pass freely into through the doorway.

SUMMARY OF THE PRESENT DEVELOPMENT

The present development is a screened door covering made from mesh screening material that hangs loosely in a doorway and that creates a mesh barrier along the side panels of the doorway. Because the screening material is not mounted in a frame, small children and pets can pass through the doorway easily. However, because the screened door covering is designed to create a mesh barrier along the side panels of the doorway, insects and debris are restricted from passing through the doorway.

DETAILED DESCRIPTION

Figure 1:
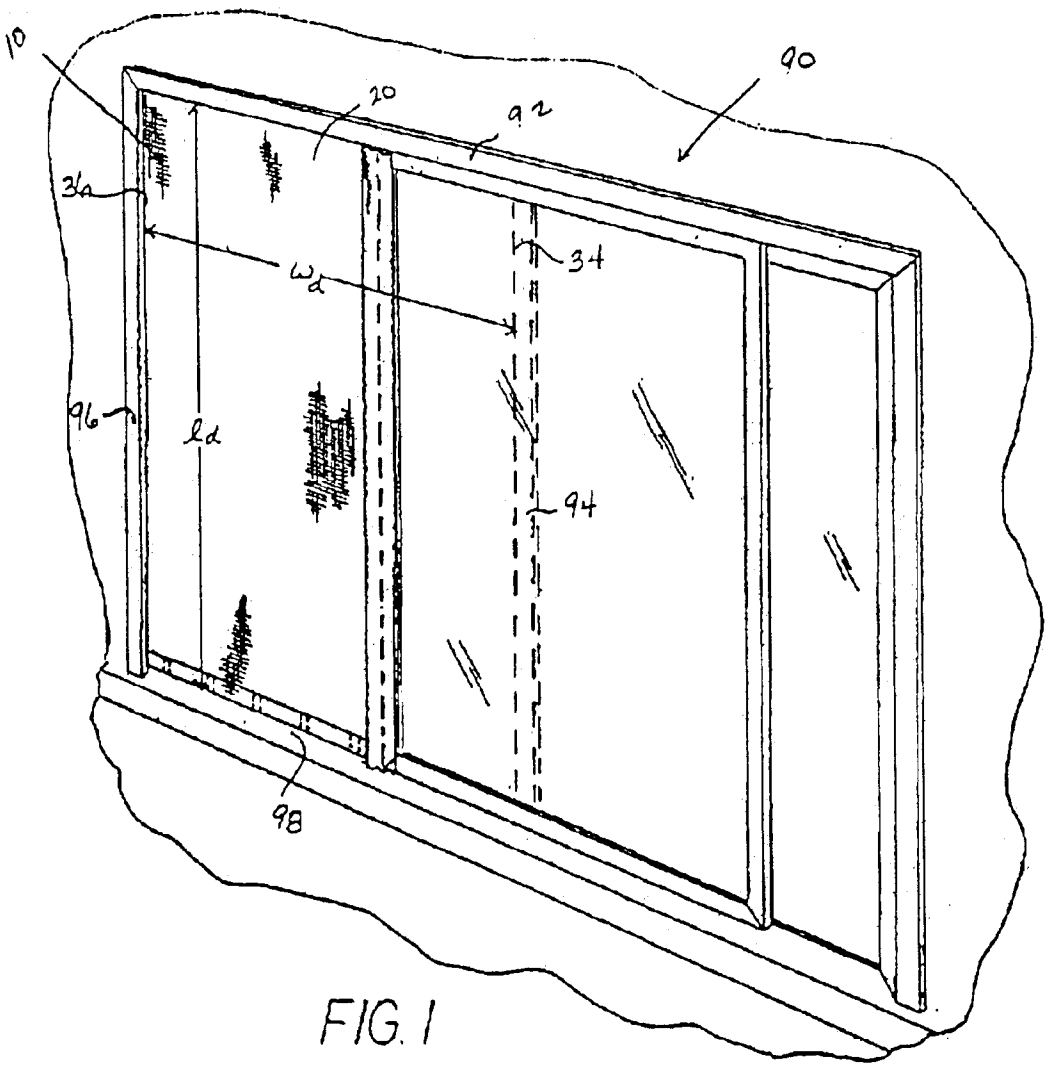
FIG. 1 is a perspective view of a screened door covering made in accordance with the present invention.

The present development is a screened door covering. As shown in FIG. 1, a screened door covering 10 is designed for use in a standard doorway or door opening 90 having a top frame 92, a hinged or fixed side 94, an open side 96, and a base 98. Alternatively, the door covering 10 could be adapted for use in a larger door opening, such as a garage door, or may be used across a barn or stable doorway.

Figure 2:
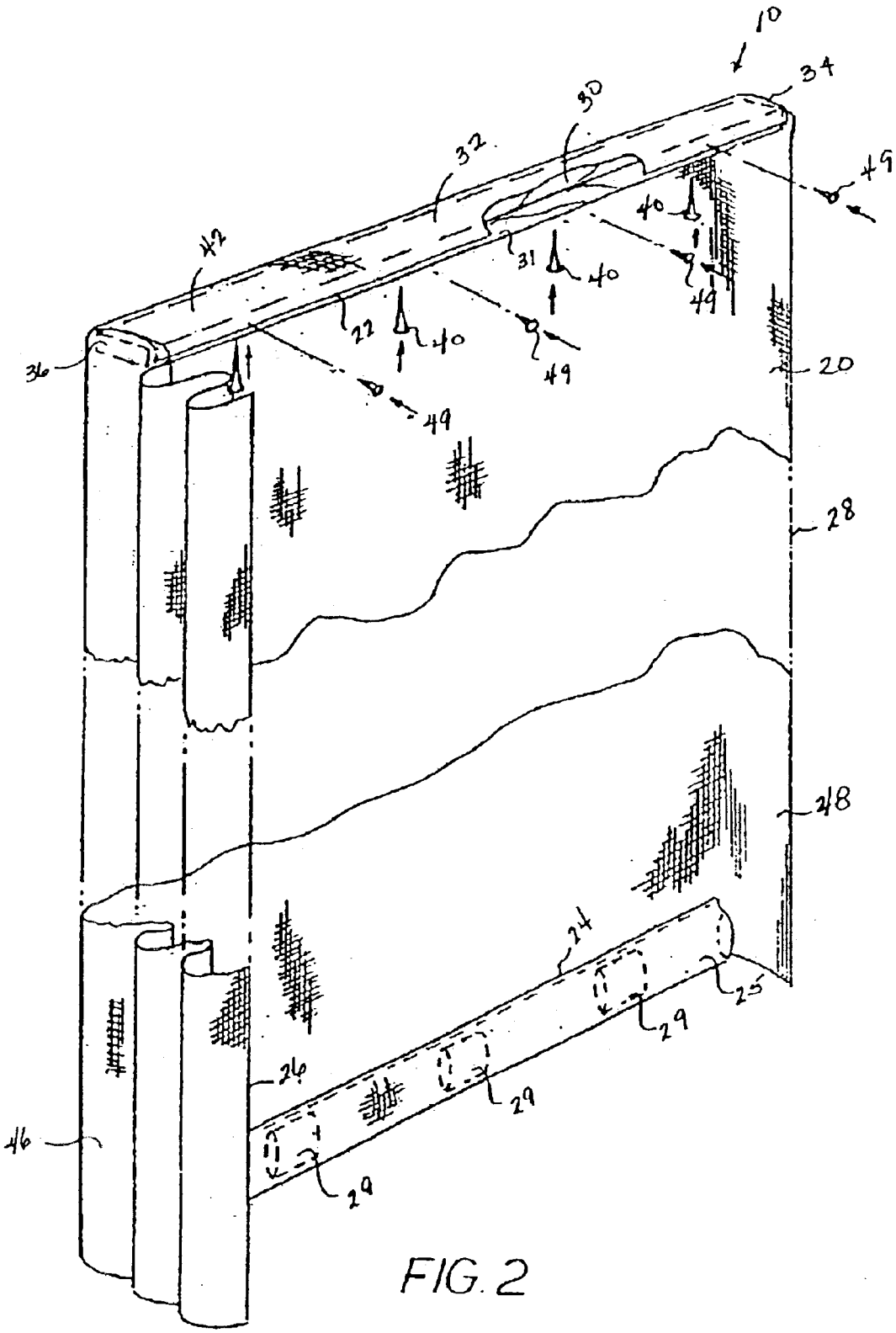
FIG. 2 is a perspective view of the screened door covering of FIG. 1 showing the folding pattern for the side folds.
Figure 3:
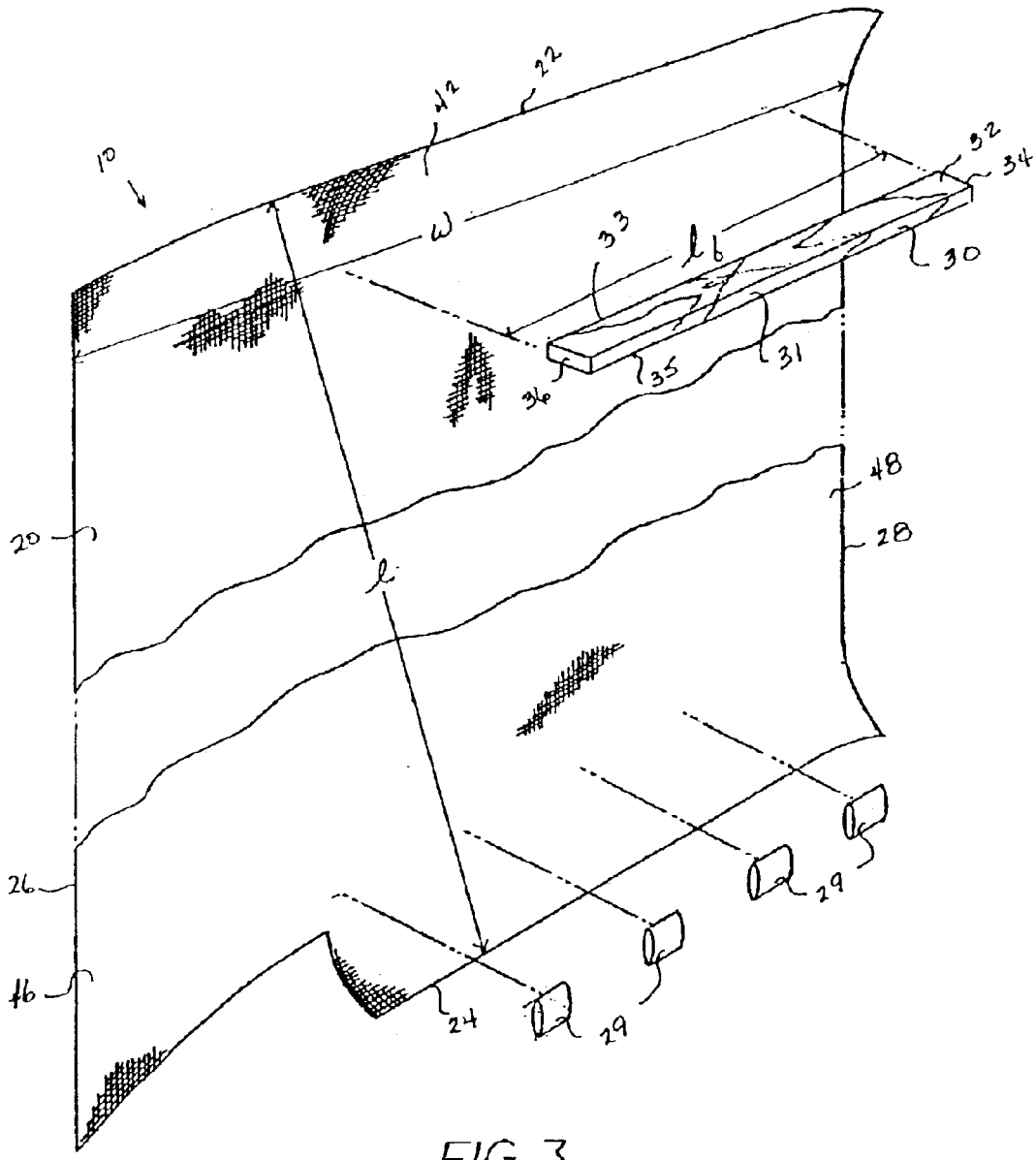
FIG. 3 is an exploded perspective view of the screened door covering of FIG. 1 before the screening material is folded and secured to the bar.

Referring to FIGS. 1–3, the screened door covering 10 comprises a mesh screening material 20, a mounting bar 30, and a means 40 for securing the mounting bar to the door top frame 92. The mesh screening material 20 can be any material which will allow for adequate ventilation through the screening but that will prevent small insects and debris from passing through the mesh of the screening. Further, the material 20 should be sufficiently pliable that it can drape or drop in folds. The material 20 is preferably cut into an essentially rectangular shape with a top edge 22, a bottom edge 24, a first side edge 26 and a second side edge 28. The material 20 has a width "w" which is slightly greater than the door opening width "$W_d$" or the distance between the fixed side 94 and the open side 96 of the doorway. Preferably, the material 20 has a width "w" about 5" greater the doorway opening "$w_d$". The material 20 also has a length "1" which is essentially perpendicular to the width "w". The length "1" is preferably greater than about one-half the doorway length, "$1_d$"—the distance between the top frame and the base—but less than the doorway length. The mesh screening material 20 is intended to cover a majority of the door opening 90, although it is not necessary for the material to reach the base 98. Optionally, the bottom edge 24 of the material 20 may be trimmed so that a hem 25 can be formed and weights 29 or similar weighting materials may be inserted in the hem.

The mounting bar 30 is a relatively rigid unit, such as a wooden slat or a plastic bar, having a length "$1_b$" approximately equal to the doorway width, "$w_d$". The mounting bar 30 defines a top 32, a front edge 31, a rear edge 33, a first end 36, a second end 34 and a bottom 35. The rear edge 33 of the mounting bar 30 is secured to the mesh screening material 20, such as with glue or similar adhesive, and is positioned on the mesh screening such that a small amount of mesh or remnant 42 remains along the top edge 22, a small remnant 48 remains along the second side edge 28 and a greater remnant 46 remains along the first side edge 26 as compared to the second side remnant 48.

As shown in FIG. 2, when the screening material 20 is secured to the mounting bar 30, it is folded about the mounting bar 30. The first side remnant 46 wraps around the first end 36 forming initially a U-shape, but it is then folded back upon itself at least one time to form an S-shape or accordion fold and is secured to the front edge 31. The second side remnant 48 wraps around the second end 34 forming a U-shape and is secured to the front edge 31. The top remnant 42 wraps over the top 32 of the bar 30 and is secured to the front edge 31. Any appropriate means 49, such as tacks, nails, screws, glue or adhesive, can be used to secure the mesh material 20 to the bar 30.

The mounting bar 30 is secured to the top frame 92 with securing means 40, such as small nails, tacks, screws, brads or similar devices. The securing means 40 protrude through the mounting bar 30 and through the top remnant 42 and into the top frame 92, with the mounting bar 30 situated such that the second end 34 with the U-folded mesh faces the fixed side 94 and the first end 36 with the S-folded mesh faces the open side 96. With this orientation, when the mounting bar 30 is secured to the top frame 92, the screen material 20 hangs loosely in the doorway 90 so that small children or pets can pass through the screen easily, but insect and debris entry is restricted.

In an alternative embodiment, the screening material 20 may have a width "w" which allows for the material to be gathered or shirred. In this embodiment, a rod pocket (not shown) may be added in close proximity to the top edge 22. The rod pocket can be formed by folding over the top edge 22 and basting the material in place, or by adding a relatively thin strip of fabric to the screening material 20. The thin strip of fabric should be positioned so about ½" of top edge 22 is visible above the strip, and should leave the first side remnant 46 and the second side remnant 48 free. The mounting bar 30 is inserted into the pocket, the material 20 is gathered so the ends 34, 36 of the bar are approximately at the ends of the pocket, and the remnants 46, 48 are wrapped and folded about the bar as in the first embodiment 10. When the screened door cover is mounted in the doorway, the gathered edge near the top edge 22 angles outwardly slightly causing the drip line to be altered and minimizing the probability of rain water coming though the screen.

The screened door covering 10 can be adapted for use on different types of doorways. For example, the screen material and mounting bar may be adapted to be secured across a garage door opening with one side of the garage door opening defining the fixed side and the opposing side defining the open side. Alternatively, a screened door covering of the present invention may be used across a garage door opening by having the sides of the garage door opening define fixed sides and an essentially midpoint position of the opening define the open side. The screened door covering 10 can also be adapted for use across a barn or stable entryway. For a barn opening, the door covering 10 may be shortened to about one-half the length of the doorway.

From a reading of the above, one with ordinary skill in the art should be able to devise variations to the inventive features. These and other variations are believed to fall within the spirit and scope of the present development.

I claim:

1. A screened door covering for a doorway opening having a top frame, a hinged side, an open side and a base, comprising:

a mesh screen material having a first side with an accordion-fold abutting said doorway opening open side, a second side abutting said doorway opening hinged side, a top side affixed to said doorway opening top frame and a bottom side, said mesh screen material having a width greater than the width of said doorway opening; and a mounting bar secured to said doorway opening top frame and affixed to said mesh screen material in proximity to said top side and closer to said second side than said first side, such that a greater remnant of said mesh screen material is left free on said first side than said second side.

2. The screened door covering of claim 1, said mesh screen material having a length of at least ½ the length of said doorway opening.

3. The screened door covering of claim 2, said mesh screen material having a length about equal to the length of said doorway opening.

4. The screened door covering of claim 1, said mesh screen material having a width about 5 inches greater than the width of said door opening.

5. The screened door covering of claim 1, said bottom side having a hem with at least one weight inserted therein.

6. The screened door covering of claim 1, said mounting bar being a rigid unit made of a material selected from the group consisting of wood and plastic.

7. The screened door covering of claim 6, said mounting bar having a width about equal to the width of said doorway.

8. The screened door covering of claim 7, said mesh screen material being secured to a back edge of said mounting bar, folded about said mounting bar and also secured to a front edge of said mounting bar.

9. The screened door covering of claim 8, said mounting bar further having a first side and a second side, wherein;

said first side of said mesh screen material has a first side remnant wrapped around said mounting bar first side and secured to said mounting bar front edge, and said second side of said mesh screen material has a second side remnant wrapped around said mounting bar second side and secured to said mounting bar front edge.

10. The screened door covering of claim 1, further comprising a rod pocket at said top side of said mesh screen material and wherein said mounting bar is inserted into said rod pocket prior securing to said doorway opening top frame.

11. A screened door covering for a doorway, comprising:

a mesh screen material having a first side with an accordion-fold first remnant, a second side opposite said first side with a second remnant, a top side and a bottom side; and a mounting bar affixed to said mesh screen material in proximity to said top side and closer to said second side than said first side, such that said first remnant has a width longer than said second remnant.

12. The screened door covering of claim 11, said mesh screen material having a rectangular shape.

13. The screened door covering of claim 11, said bottom side having a hem with at least one weight inserted therein.

14. The screened door covering of claim 11, said mounting bar being a rigid unit made of a material selected from the group consisting of wood and plastic.

15. The screened door covering of claim 14, said mounting bar having a width less than the width of said mesh screening material.

16. The screened door covering of claim 15, said mesh screen material being secured to a back edge of said mounting bar, folded about said mounting bar and also secured to a front edge of said mounting bar.

17. The screened door covering of claim 16, said mounting bar further having a first side and a second side, wherein;

said first remnant is wrapped around said mounting bar first side and secured to said mounting bar front edge, and said second remnant is wrapped around said mounting bar second side and secured to said mounting bar front edge.

18. The screened door covering of claim 11, further comprising a rod pocket at said top side of said mesh screen material and wherein said mounting bar is inserted into said rod pocket.

19. A screened door covering for a doorway opening having a top frame, a hinged side, an open side and a base, comprising:

a rectangular mesh screen material having a first side with a first remnant abutting said doorway opening open side, a second side with a second remnant abutting said doorway opening hinged side, a top side affixed to said doorway opening top frame and a bottom side, said mesh screen material having a width greater than the width of said doorway opening and said second remnant having a width less than the width of said first remnant;

a mounting bar having a front edge, a back edge, a first side and a second side and being secured to said doorway opening top frame and said back edge being affixed to said mesh screen material in proximity to said mesh screen material top side; and wherein said first remnant is wrapped around said mounting bar first side, gathered to form an S-shape fold and secured to said mounting bar front edge and said second remnant is wrapped around said mounting bar second side, gathered to form a U-shaped fold and secured to said mounting bar front edge.

20. The screened door covering of claim 19, further comprising a hem at said bottom edge, said hem containing at least one weight therein.

21. A screened door covering for a doorway, comprising:

a mesh screen material having a top side, a first side and a second side;

a mounting bar secured to said doorway and said mesh screen material top side; and an S-shaped fold extending from said first side and abutting said doorway.

* * * * *